United States Patent [19]

Tsukasaki

[11] 4,363,478

[45] Dec. 14, 1982

[54] METHOD AND APPARATUS OF FEEDING CORRUGATED BOARDS

[76] Inventor: Yasuhiro Tsukasaki, 2-19, 4-chome, Higashi Kagaya, Suminoeku, Osakashi, Japan, 559

[21] Appl. No.: 175,772

[22] Filed: Aug. 6, 1980

[30] Foreign Application Priority Data

Aug. 8, 1979 [JP] Japan ..... 54/101680[U]
Jan. 9, 1980 [JP] Japan ..... 55/1484[U]

[51] Int. Cl.[3] ..... B65H 5/00

[52] U.S. Cl. ..... 271/10; 271/134; 271/138; 271/276

[58] Field of Search ..... 271/10, 138, 134, 276, 271/197

[56] References Cited

U.S. PATENT DOCUMENTS

| | | | |
|---|---|---|---|
| 2,339,268 | 1/1944 | Huffman | 271/197 X |
| 2,915,309 | 12/1959 | McGihon | 271/138 X |
| 3,599,967 | 8/1971 | Rapparlie | 271/276 X |
| 3,780,960 | 12/1973 | Tokuno | 271/197 X |

*Primary Examiner*—Richard A. Schacher

[57] ABSTRACT

The corrugated boards contained in a hopper are individually kicked out onto conveyor belts on which each board firmly sticks thereto under suction from below, and are fed to a subsequent processing station, such as a printing station, thereby enabling the individual boards be fed in their right posture to a right place in the processing station.

3 Claims, 15 Drawing Figures

METHOD AND APPARATUS OF FEEDING CORRUGATED BOARDS

BACKGROUND OF THE INVENTION

1. Field of the Invention

The present invention relates to a method and apparatus of feeding corrugated boards (hereinafter referred to merely as a board) to a box processing machine. More particularly, the present invention relates to a method and apparatus of feeding individual boards in their right posture to a right place in the box processing machine, wherein the boards are previously cut to a required size with slits and longitudinal flutes.

2. Description of the Prior Art

Conventionally, a box processing machine employs a contrivance for feeding boards, which are previously cut to a required size with slits and first folding flutes. The boards are contained in a hopper from which they are fed one at a time to a subsequent processing station. In such cases it is common practice to employ feeding rollers located between the hopper and the processing station, which is most commonly a printing station. As is generally known, it is essential to feed boards consistently to the right place in the printing station in their right posture to avoid printing shears.

In a conventional feeding system, however, a difficulty has been found in feeding boards with flutes. The fluted parts are thin compared with the other plane parts of the board, and these parts tend to cause the boards to slip between the feeder rollers, and consequently, permit the boards to become displaced from their right posture. In order to solve this problem, the gap between the feeder rollers were slightly restricted. But the restricted gap tends to crush the corrugated cores in the board and to deform the same. When damaged in the corrugated core, the board is liable to breakage therefrom.

The present invention is directed toward solving the problems pointed out above with respect to the conventional feeding system, and has for its object to provide an improved method and apparatus for feeding boards in their right posture to a right place in the subsequent processing station.

Other objects and advantages of the present invention will become apparent from the detailed description given hereinafter; it should be understood, however, that the detailed description and specific embodiments are given by way of illustration only, since various changes and modifications within the spirit and scope of the invention will become apparent to those skilled in the art from this detailed description.

SUMMARY OF THE INVENTION

According to one advantageous aspect of the present invention, a board feeding apparatus includes a plurality of guide bars and conveyor belts alternately located in the feeding direction, the conveyor belt including porous parts and non-porous parts, wherein the porous parts are located at intervals of a distance equal to the circumference of an impression cylinder in the printing station, and wherein the porous parts are provided with pores allowing a sucking pressure to pass through, the top surfaces of the porous parts slightly rising above those of the guide bars while the top surfaces of the non-porous parts lying below the same.

According to another advantageous aspect of the present invention, a board feeding apparatus includes a hopper whose front walls are movable in the feeding direction, thereby enabling the hopper to contain any size of board.

According to a further advantageous aspect of the present inventin, the boards contained in a hopper are individually kicked out onto a conveyor belts on which each board sticks thereto under suction from below, and they are fed in their right posture to a right place in the subsequent processing station.

DETAILED DESCRIPTION OF THE INVENTION

Figure 1:
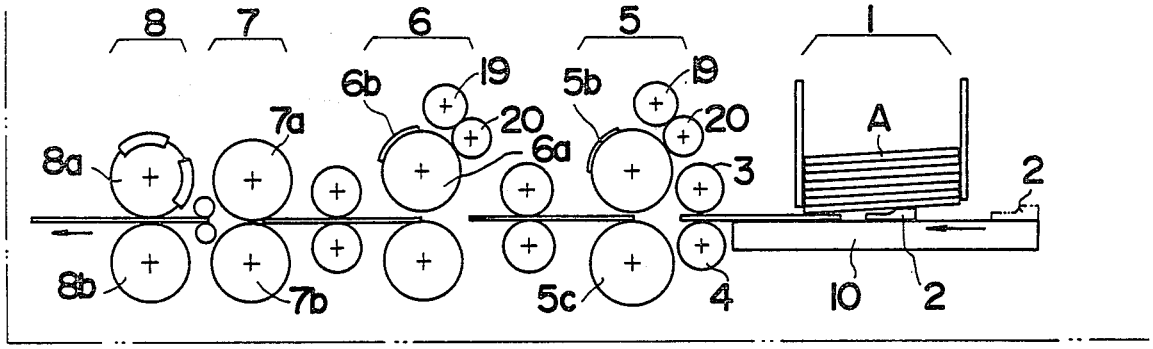
FIG.1 (Prior Art)
FIG. 1 is a schematic view showing an overall appearance of a prior art box processing machine.
Figure 2A:
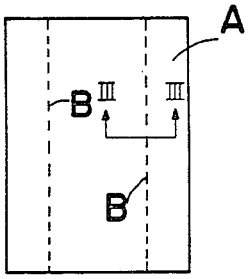
FIG. 2*a* and 2*b* are explanatory views showing a known corrugated board used for making boxes, such as cartons.
Figure 2B:
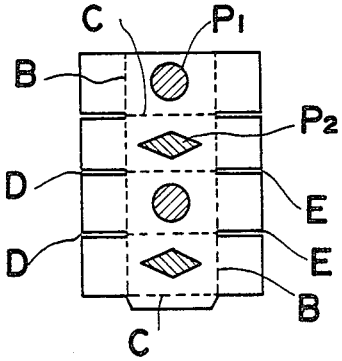
Figure 3:
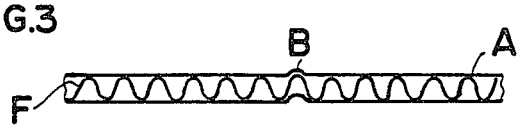
FIG. 3 is a cross-section along III—III in FIG. 2*a*.

As shown in FIG. 1, a conventional corrugated board box processing machine includes a hopper 1, a first printing station 5, a second printing station 6, a fluting station 7 and a slotting station 8. The material (A) contained in the hopper 1 is corrugated boards each cut to a required size and shape shown in FIG. 2*a*, wherein the board (A) is previously provided with longitudinal flutes (B). The boards are fed from the hopper 1 to the first printing station 5, to the second printing station 6 (when required, the third, fourth . . . printing stations), the fluting station 7 and to the slotting station 8. In the fluting station 7 the board is provided with second or crosswise flutes as indicated in FIG. 2*b* by dotted lines (C). These longitudinal and crosswise flutes are intended to facilitate folding the board into a box. FIG. 3 shows a cross-section of a corrugated board in which a corrugated core (F) is provided. It will be noticed that the fluted parts (B) are thin compared with the other plane part of the board; in other words these parts constitute bulged lines in one surface. The board is additionally provided with printed letters and design ($P_1$) and $P_2$), and with slots (D) and (E).

Figure 4:
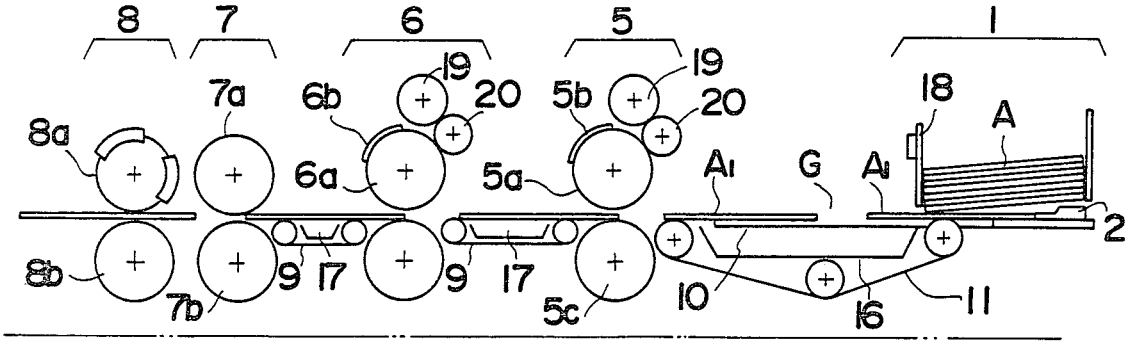
FIG. 4 is a simplified schematic side view showing an overall appearance of a box processing machine including a board feeding apparatus constructed in accordance with the present invention.

According to the present invention, the feed rollers 3 and 4 in FIG. 1 are replaced by a unique feeding apparatus (G) shown in FIG. 4.

As shown in FIG. 4 a board box processing machine also includes a first printing station 5, a second printing station 6, a fluting station 7 and a slotting station 8. Reference numerals 5*a* and 6*a* designate impression cylinders in the first and second printing stations, respectively, wherein the respective impression cylinders are provided with the printing blocks 5*b* and 6*b*. Reference numerals 7*a* and 7*b* designate fluting rollers, and reference numerals 8*a* and 8*b* designate slotting rollers. The board is fuerther fed by intermediate belts 9. Preferably, the intermediate belts 9 are provided with ducts 17 through which a sucking pressure is applied to the belts 9 from below. The printing stations 5 and 6 include inking rollers 19 and 20 in the known manner.

Figure 5:
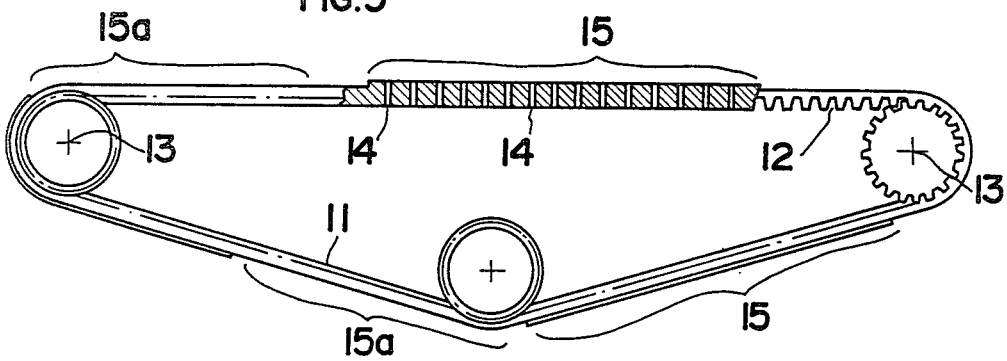
FIG. 5 is a side view of a conveyor belt included in the board feeding apparatus in FIG. 4.
Figure 6:
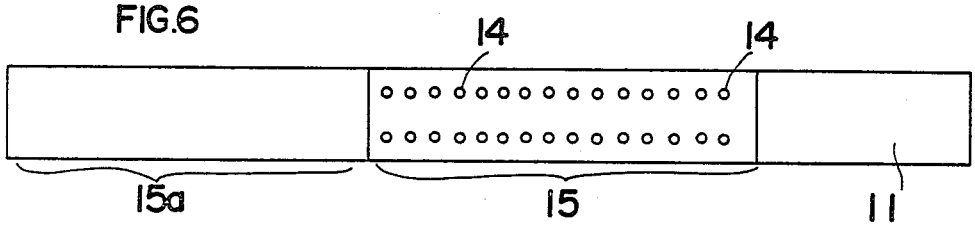
FIG. 6 is a plan view of the conveyor belt in FIG. 5.
Figure 7:
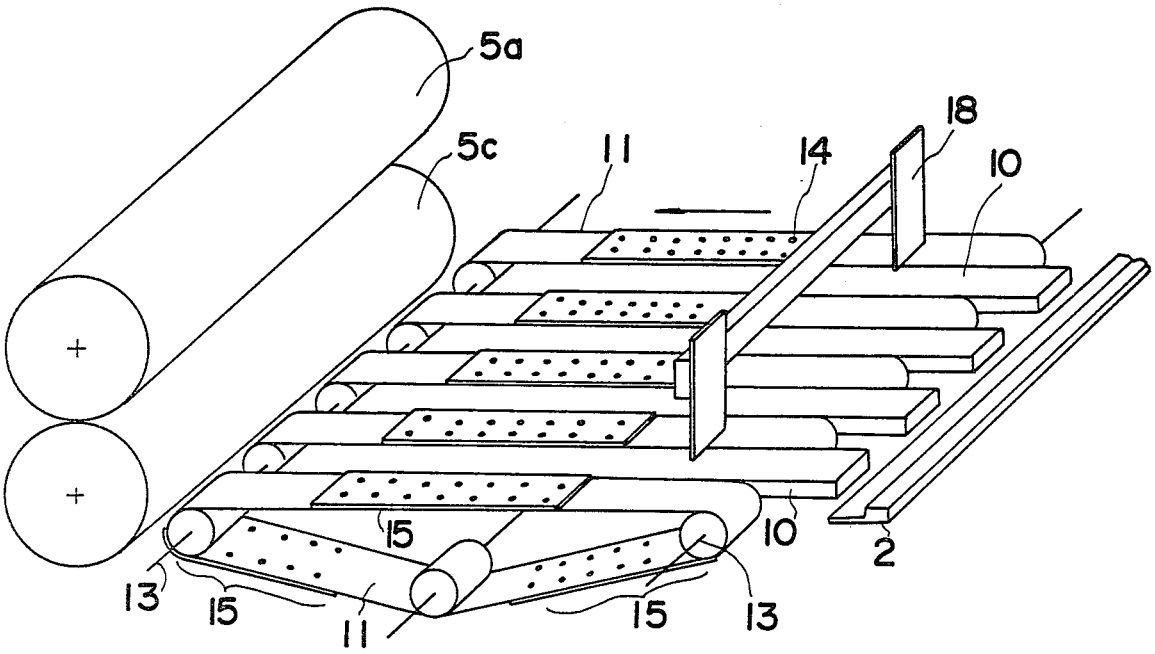
FIG. 7 is a schematic view of the main part of the board feeding apparatus in FIG. 4.
Figure 9:
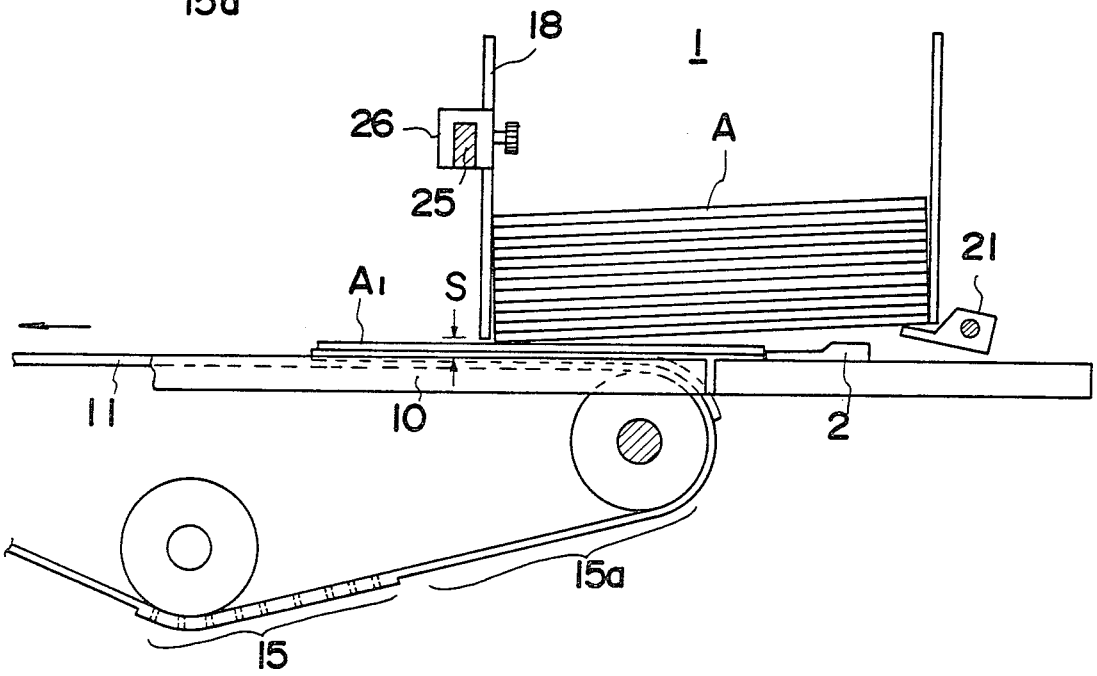
Figure 10:
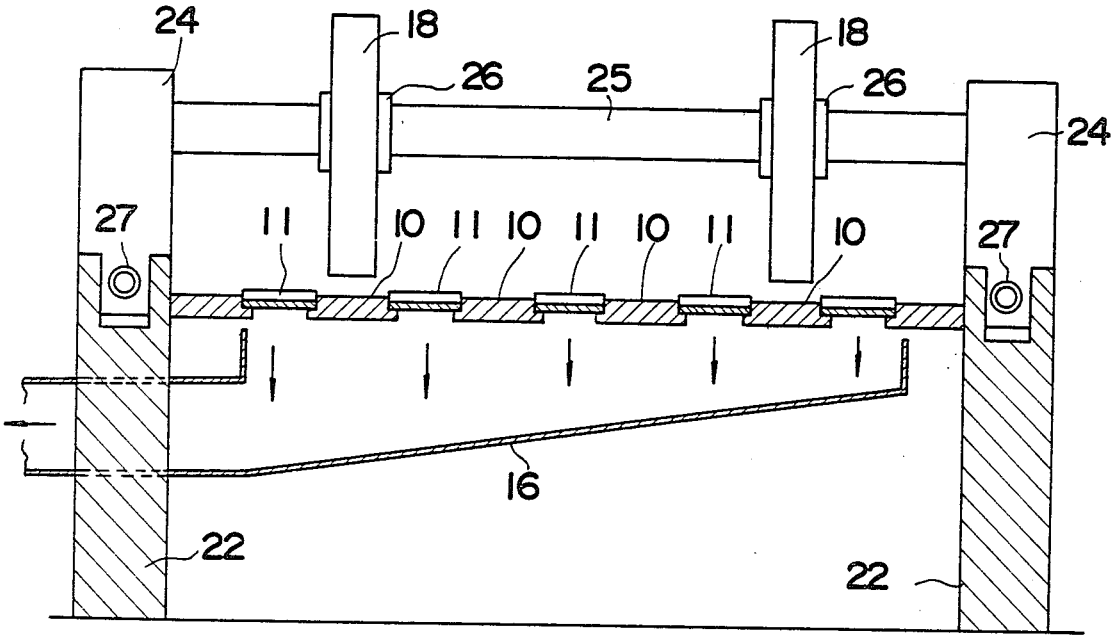
FIG. 10 is a view of the front walls of the hopper, particularly showing a relationship between the front walls and the conveyor belts.
Figure 11:
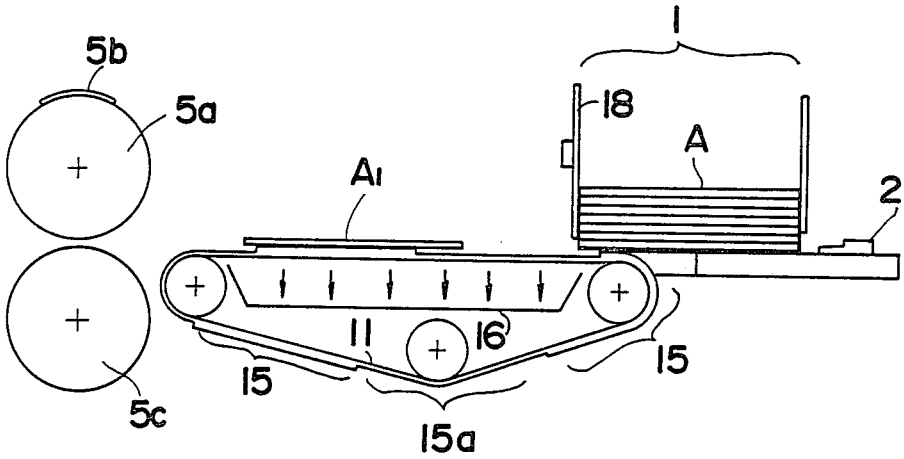
FIGS. 11 and 12 are schematic views of the board feeding apparatus constructed in accordance with the present invention.
Figure 12:
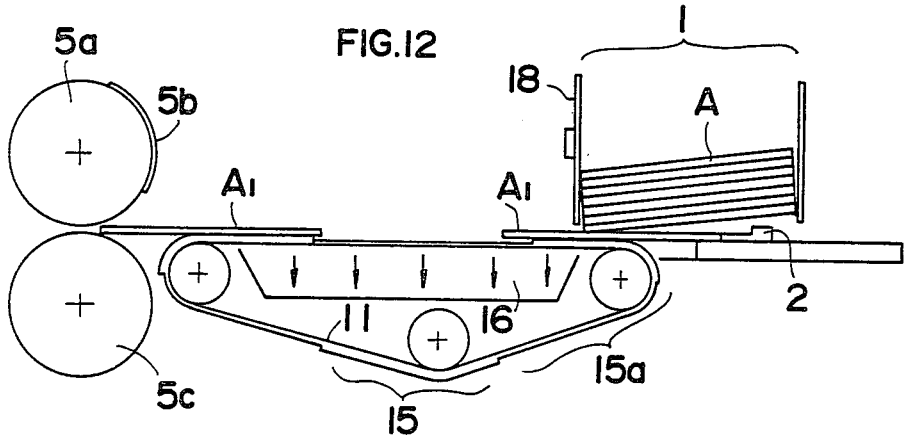

Referring to FIG. 7, the feeding aparatus (G) includes guide bars 10 and endless conveyor belts 11 alternately located in the feeding direction between the hopper 1 and the first printing station 5. The hopper 1 includes front walls 18, which are suspended with an allowance (S) against the guide bars 10 so as to allow the board ($A_1$) to pass through as best shown in FIG. 9. The boards (A) in the hopper 1 are individually kicked out by means of a kicker 2. The conveyor belts 11 are carried on a common pair of shafts 13, and are rotated in the same direction as indicated by an arrow in FIG. 7. Each conveyor belt 11 has porous parts 15 and non-porous parts 15*a*, (FIG. 6) wherein the porous parts are provided with pores 14 through which a sucking pressure is applied from below. The effective length of each conveyor belt is an integral multiple of the circumference of an impression cylinder 5*a*. The porous parts 15 are located at intervals of a distance equal to the circumference of the impression cylinder 5*a*. Under the guide bars a duct 16 (FIG. 4) is provided so as to allow a sucking pressure to apply to the pores 14. Thus, the board ($A_1$) on the porous part is caused to stick thereto under suction. This prevents the board from displacing on the conveyor belts, and its correct posture is maintained until it reaches the printing station. The porous parts 15 and the non-porous parts 15*a* are different in thickness with respect to the top surface of the guide bars 10, that is, the porous parts are kept higher than the guide bars while the non-porous parts are kept lower. As shown in FIG. 5, the conveyor belts 11 are provided with teeth 12 at their back so as the engage toothed wheels 13. The impression cylinders 5*a* and 6*a*, the fluting rollers 7*a* and 7*b*, the slotting rollers 8*a* and 8*b* and the intermediate belts 9 are synchronously driven at the same speed by a common electric motor (not shown).

Figure 8:
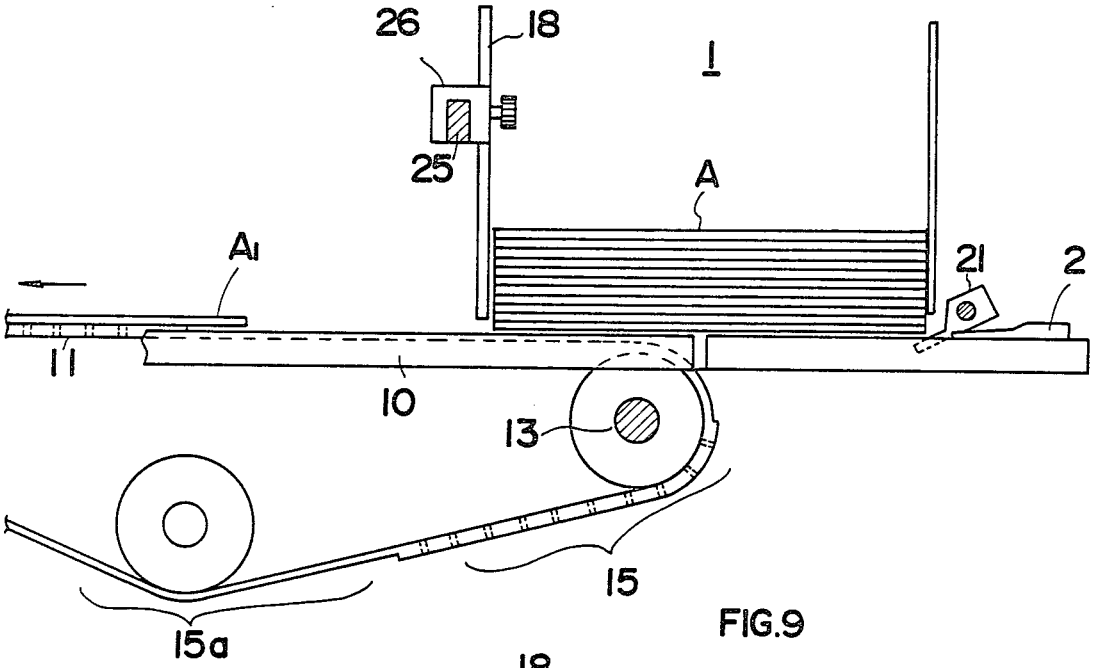
FIGS. 8 and 9 are schematic views on an enlarged scale of the hopper and the conveyor belts, particularly showing a relationship between the board to be transported and the conveyor belts.

The kicker 2 is located under the hopper 1 in such a manner as to reciprocally move by power (whose details are not shown), and pushes the boards (A) individually onto the conveyor belts 11 by its forward movement as shown in FIGS. 8 and 9. It is arranged that the kicker 2 finishes its one reciprocal movement in a period of time in which the impression cylinder 5*a* rotates 360°. Preferably, the advancing speed of the kicker 2 is equal to the circumferential speed of the conveyor belts 11. In addition, it is arranged that the kicker is started when one of the porous parts 15 comes under the last laid board in the hopper.

Referring to FIGS. 8 and 9 a lever 21 is provided adjacent to the kicker 2, the lever 21 being adapted to raise other boards than the last laid one by its rotary movement so as to allow the kicker to pass through to push the board ($A_1$) alone. The lever 21 and its driving mechanism are known, and a detailed explanation will be omitted.

Figure 13:
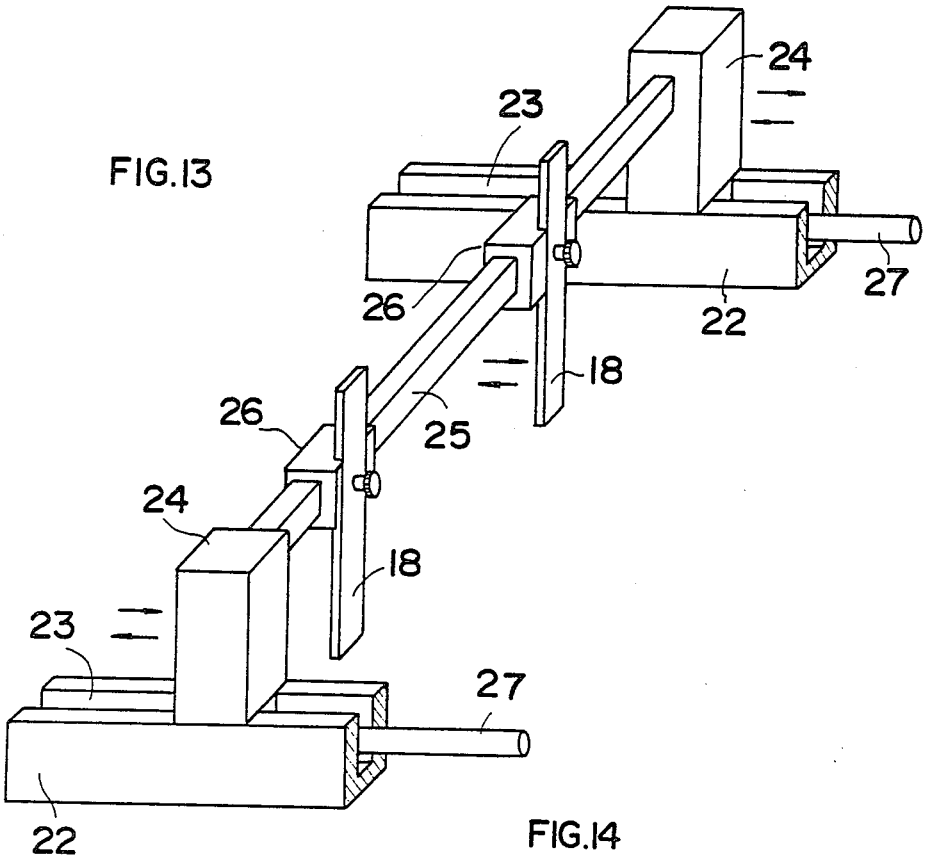
FIG. 13 is a schematic perspective view of the front walls of the hopper.
Figure 14:
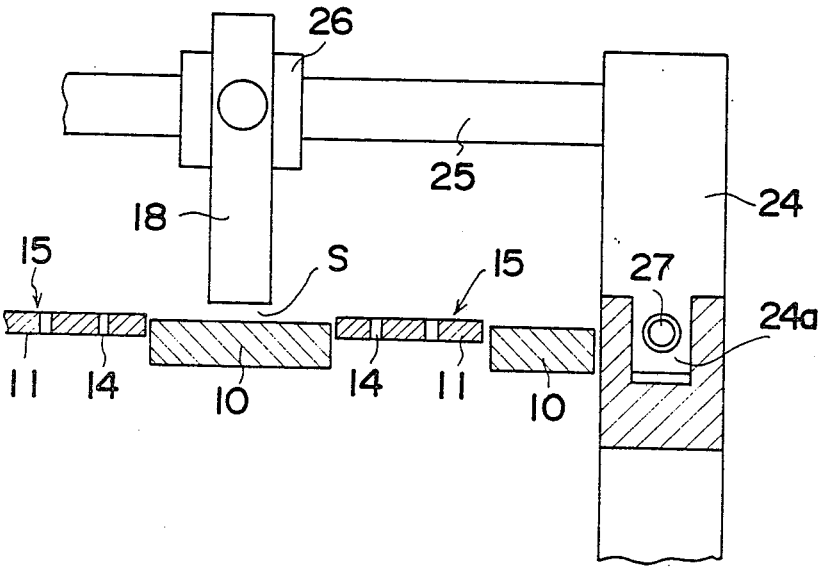
FIG. 14 is a front view on an enlarged scale of the main part of the front walls of the hopper, particularly showing a relationship between the front walls and the conveyor belts.

Referring to FIGS. 13 and 14 the front walls 18 of the hopper are supported on a beam 25 through sliders 26 which are slidable along the beam. The beam 25 is supported on standards 24 slidably supported on side frames 22. As shown in FIG. 14 the standards 24 have projections 24*a* at their bottom, which projections are slidably fitted in grooves 23. Each projection 24*a* has a screw bar 27 passing therethrough so as to allow the standard 24 to reciprocally move as indicated in FIGS. 13 by arrows. In this way the front walls 18 are adjusted to the size of the boards to be laid in the hopper, wherein the front walls 18 are suspended with the allowance (S) above the guide bars 10 as shown in FIG. 14. The allowance (S) is slightly restricted by the porous parts 15 in the conveyor belts 11, but nevertheless the restricted allowance is such as to permit the board ($A_1$) to pass through.

In operation, the main electric motor (not shown) is switched on to start the kicker 2, the conveyor belts 11, the printing stations 5 and 6, the fluting station 7, the slotting station 8 and the intermediate belts 9 at the same time. When the porous part 15 in the conveyor belts 11 comes under the lowest board ($A_1$) in the hopper, the kicker 2 starts to push it, and simultaneously the lever 21 raises the other boards (A) so as to allow the kicker to advance further. The board ($A_1$) is pushed onto the conveyor belts where it sticks to the surfaces under suction from below, thereby ensuring that the board ($A_1$) is fed to the printing station 5 without undesirable displacement on the conveyor belts, which otherwise would be likely to cause printing shears. In this way the board ($A_1$) is fed in its right posture to a right place in the first printing station 5, to the second printing station 6, to the fluting station 7 and to the slotting station 8.

As described above, the thicknesses of the porous parts 15 and the non-porous parts 15*a* are different, and as a result, the top surfaces of the non-porous parts lie below those of the guide bars 10, which means that the top surfaces of the non-porous parts are kept free from contact with the board lying on the guide bars. Accordingly, there is no danger that the board ($A_1$) will be damaged by the running conveyor belts before the kicker is started.

The hopper is previously adjusted to the size of board to be handled by advancing or withdrawing the front walls 18.

What is claimed is:

1. An apparatus for feeding corrugated boards to a printing station comprising:

a hopper for containing a stack of said boards;

means for conveying one of said boards from said hopper to said printing station;

said means for conveying having a plurality of belts including porous portions longitudinally interspersed with other portions;

one guide bar intermediate each adjacent pair of said plurality of belts; and said porous portions projecting above a top surface of said guide bars and said other portions being depressed below said top surface;

means for applying suction through said porous portions whereby said one of the boards is adhered to said plurality of belts.

2. An apparatus for feeding box-making corrugated boards to a subsequent printing station, the apparatus comprising:

a plurality of guide bars located in a feeding direction;

said guide bars extending from under a hopper to said printing station;

a plurality of conveyor belts located alternately with said guide bars;

each of said conveyor belts including porous parts adapted to allow a sucking pressure to pass through, wherein the top surfaces of said porous parts rise above those of said conveyor belts;

said porous parts being located at intervals of a distance equal to the circumference of an impression cylinder in said printing station; and means for allowing a sucking pressure to apply to said porous parts of said conveyor belts, wherein said means is located under said conveyor belts.

3. An apparatus as defined in claim 2, further comprising a means for adjusting said front wall of said hopper with respect to the size of boards to be processed.

* * * * *